US008992389B2

(12) United States Patent
Abel et al.

(10) Patent No.: US 8,992,389 B2
(45) Date of Patent: Mar. 31, 2015

(54) MULTI-DIRECTIONAL ADJUSTABLE EXERCISE SLIDE BOARD

(76) Inventors: Christianna Abel, Williamstown, MA (US); David H. Armet, Williamstown, MA (US)

( * ) Notice: Subject to any disclaimer, the term of this patent is extended or adjusted under 35 U.S.C. 154(b) by 258 days.

(21) Appl. No.: 13/567,032

(22) Filed: Aug. 4, 2012

(65) Prior Publication Data

US 2013/0035211 A1 Feb. 7, 2013

Related U.S. Application Data

(60) Provisional application No. 61/515,110, filed on Aug. 4, 2011.

(51) Int. Cl.

| | |
|---|---|
| ***A63B 22/00*** | (2006.01) |
| ***A63B 22/20*** | (2006.01) |
| ***A63B 69/00*** | (2006.01) |
| ***A63B 23/035*** | (2006.01) |
| *A63B 21/00* | (2006.01) |
| *A63B 23/12* | (2006.01) |

(52) U.S. Cl.

CPC ..... *A63B 22/20* (2013.01); *A63B 69/0057* (2013.01); *A63B 23/03541* (2013.01); *A63B 23/0355* (2013.01); *A63B 23/03575* (2013.01); *A63B 21/1473* (2013.01); *A63B 23/1236* (2013.01); *A63B 2208/0204* (2013.01); *A63B 2208/0219* (2013.01); *A63B 2208/0295* (2013.01)

USPC ..... 482/51

(58) Field of Classification Search

CPC ..... A63B 22/001; A63B 2208/0204; A63B 22/0605; A63B 2225/09; A63B 22/203; A63B 23/0488; A63B 22/20; A63B 2208/0219

USPC ..... 482/51, 79, 141–142, 145–148; 439/77; 24/578.12; D21/685–686

See application file for complete search history.

(56) References Cited

U.S. PATENT DOCUMENTS

| | | | | |
|---|---|---|---|---|
| 795,582 | A * | 7/1905 | Crosser | 2/220 |
| 4,940,226 | A * | 7/1990 | Carra | 482/51 |
| 5,352,165 | A * | 10/1994 | Koblick | 482/51 |
| 5,417,636 | A * | 5/1995 | Havens | 482/145 |
| 6,024,680 | A * | 2/2000 | Thompson, II | 482/146 |
| 6,315,695 | B1 * | 11/2001 | Follett et al. | 482/34 |
| 6,406,410 | B1 * | 6/2002 | Lochbaum | 482/111 |
| 7,364,440 | B2 * | 4/2008 | Gobron et al. | 439/77 |
| D633,158 | S * | 2/2011 | Bruschke et al. | D21/686 |
| 2003/0119634 | A1 * | 6/2003 | Schaeffer | 482/74 |
| 2004/0014571 | A1 * | 1/2004 | Haynes | 482/142 |
| 2004/0220018 | A1 * | 11/2004 | Branson | 482/51 |
| 2006/0032412 | A1 * | 2/2006 | Harner et al. | 108/55.1 |
| 2007/0131631 | A1 * | 6/2007 | Dewey | 211/59.1 |
| 2011/0230312 | A1 * | 9/2011 | Gamboa | 482/51 |
| 2011/0230313 | A1 * | 9/2011 | Gamboa | 482/51 |
| 2012/0010051 | A1 * | 1/2012 | Bruschke et al. | 482/51 |
| 2012/0316043 | A1 * | 12/2012 | Mangalindan | 482/141 |
| 2013/0217552 | A1 * | 8/2013 | Slotnick | 482/142 |

* cited by examiner

*Primary Examiner* — Loan H Thanh
*Assistant Examiner* — Andrew S Lo
(74) *Attorney, Agent, or Firm* — Blynn L. Shideler; Krisanne Shideler; BLK Law Group

(57) ABSTRACT

An exercise apparatus providing a base having a top surface and a bottom surface, wherein the top surface is smooth and planar. The top surface includes a first plurality of apertures arranged in a circular pattern having a first diameter, and a second plurality of apertures arranged in a circular pattern having a second diameter. A plurality of repositional stops are further provided including mounting posts for securing the repositional stops within any of the first and second plurality of apertures.

20 Claims, 10 Drawing Sheets

FIG. 3
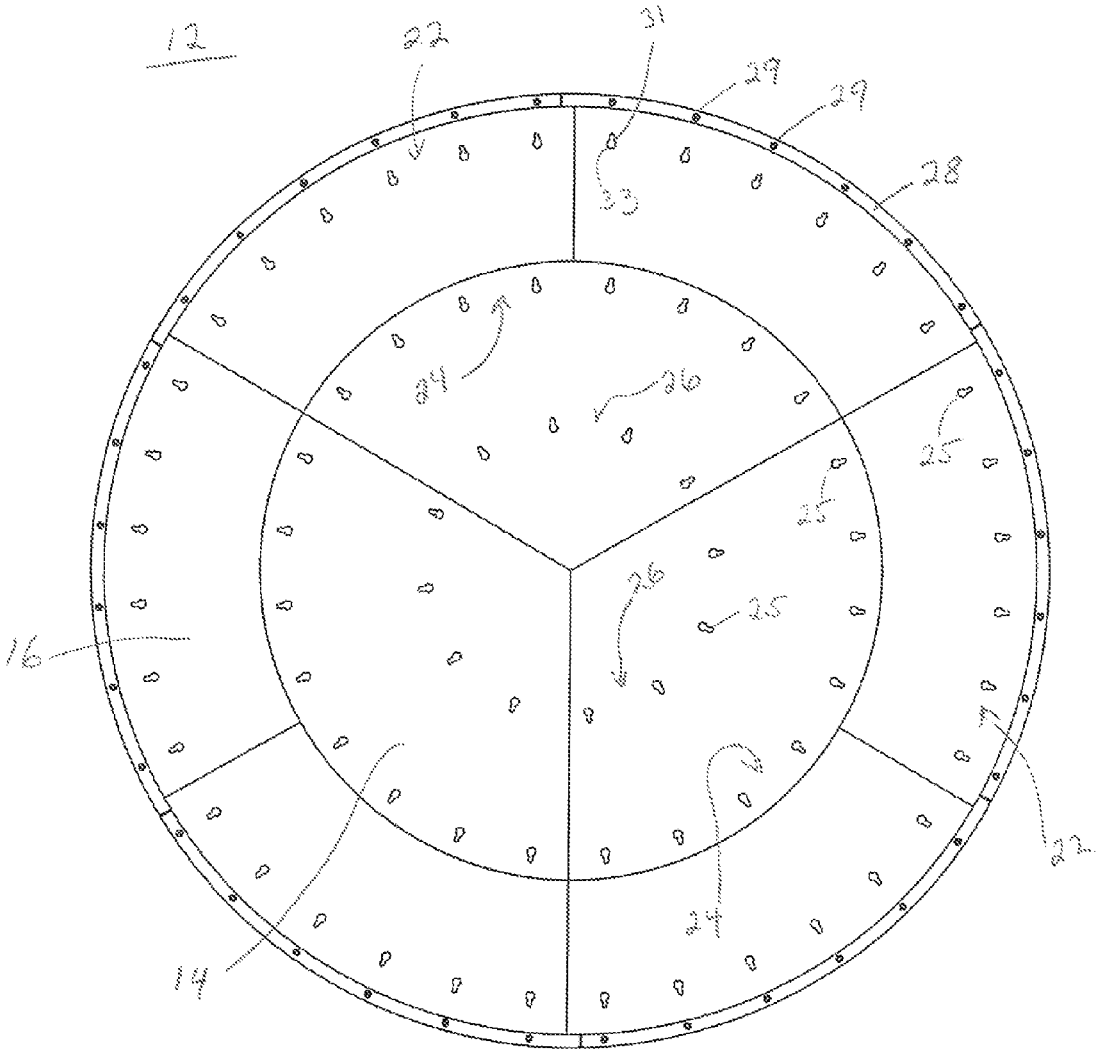
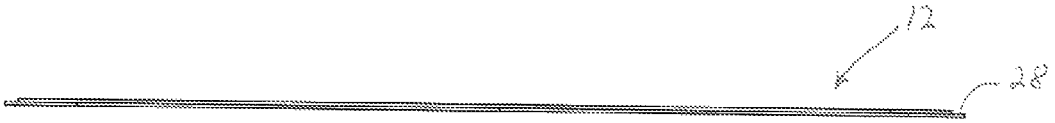
FIG. 3a

FIG. 5
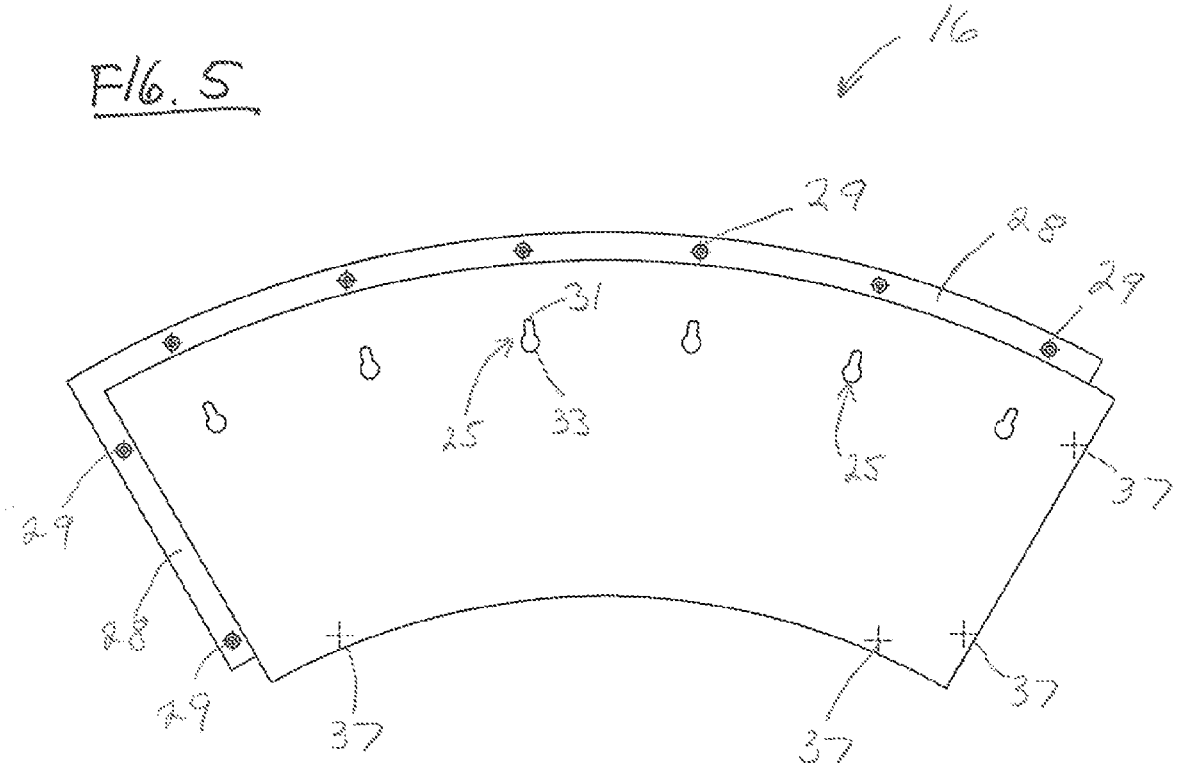
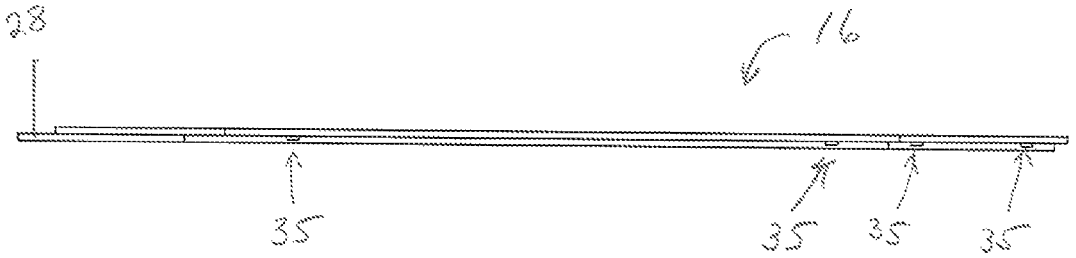
FIG. 5a

FIG. 6a
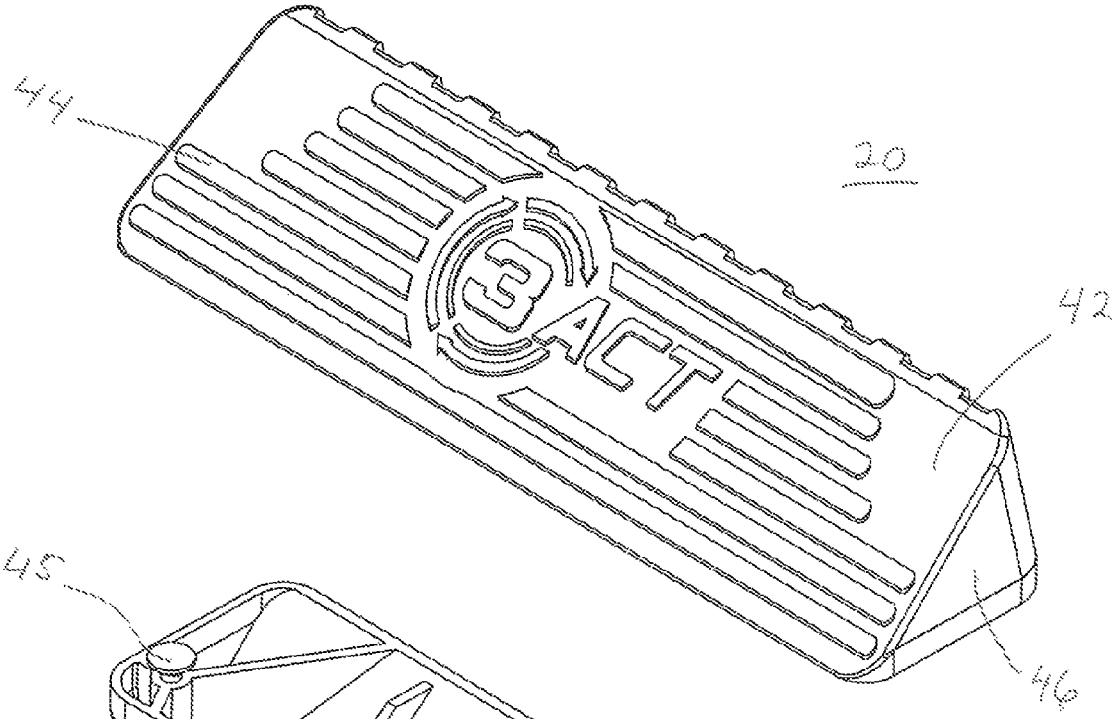
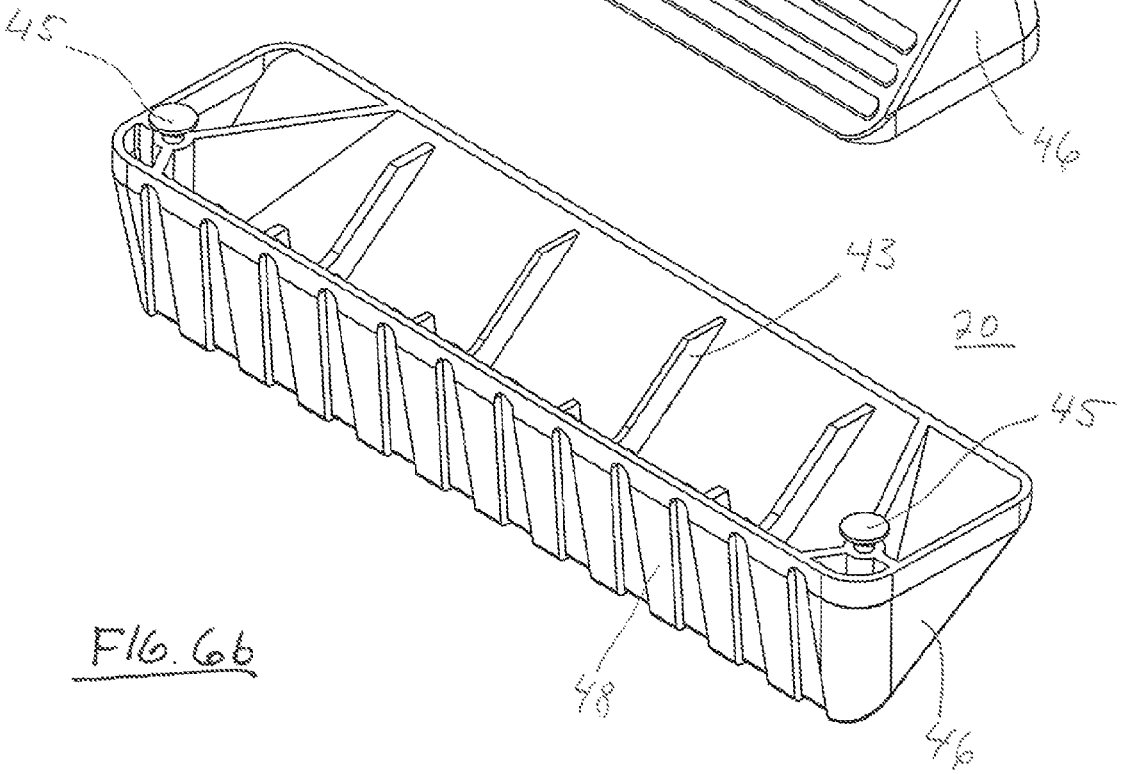
FIG. 6b

MULTI-DIRECTIONAL ADJUSTABLE EXERCISE SLIDE BOARD

REFERENCE TO RELATED APPLICATION

This patent application claims priority to U.S. provisional patent application entitled "Circle Slide Board," having Ser. No. 61/515,110, filed on Aug. 4, 2011, the entirety of which is hereby incorporated by reference into the present patent application.

BACKGROUND OF THE INVENTION

1. Field of the Invention

The present invention relates generally to exercise equipment, and more particularly, to exercise slide boards.

2. Description of Related Art

Traditional exercise slide boards, due to their rectangular shape, generally only allow bidirectional or back and forth motions. This conventional design limits a person's exercise program and targeted muscles due to the limited range of motion and limited direction offered by traditional slide boards.

Accordingly, there exists a need for an improved exercise slide board that provides a broader range of motions and greater variations in the types and directions of possible exercises.

ASPECTS AND SUMMARY OF THE PRESENT INVENTION

In order to overcome these deficiencies in the prior art, one aspect of the present invention provides a myriad of additional directions of motion beyond the conventional side to side or bidirectional motion of a typical slide board.

A further aspect of the present invention provides a circular shaped slide board in contrast to the traditional rectangular shaped slide board, wherein this configuration enables a user to exercise using a myriad of directions of motion in addition to the traditional side to side motion of a traditional exercise slide board.

In accordance with the present invention, an exercise slide board having a circular configuration is provided in order to enable numerous slide exercises, each being in a different direction. In regard to exercising, the human body can be described as moving in the three main directions: (1) the frontal plane, (2) the sagittal plane, and (3) the transverse plane. The frontal plane includes a motion occurring from side to side. The sagittal plane involves motion occurring from front to back. The transverse plane involves motion that occurs with rotational or twisting movements. Optimal exercising of the human body requires movement in all three of these planes of motion. The design of the present invention optimizes a user's ability to slide effectively through all three of these planes of motion, and in all directions related to a particular sport, exercise or activity involving specific patterns.

A preferred embodiment of the present invention provides a slide board having a circular configuration and several circular patterns defined by a plurality of apertures for receiving and securing repositional stops. The repositional stops preferably have a rectangular configuration and two mounting posts on the bottom surface at opposing ends of each repositional stop. The mounting posts on the repositioning stops are sized and configured to be inserted and locked within any of the apertures on the top surface of the slide board. A minimal number of apertures in each circular pattern are provided such that at least eight total repositioning stops can be mounted within at least two circular patterns from all eight sides of an octagon, wherein each side of the octagon is defined by a repositioning stop. Additionally, a minimal number of apertures preferably are provided in a smaller circular pattern in order to enable at least four repositional stops to be mounted to form a square. Furthermore, the size of the slide board can be increased to add additional circular patterns of apertures, wherein the number of apertures are further increased to enable more than eight repositional stops to be mounted in a circular pattern. In the preferred embodiment, at least three circular patterns or rings having a different diameter and consisting of a plurality of apertures are located on the top surface of the slide board.

The circular slide board of the present invention enables a user to place friction-reducing pads or types of clothing on their hands, feet and/or knees to slide along the slide board in multiple different directions and patterns. These sliding movements constitute training activity for general exercise, rehabilitation or strengthening of a desired area of the body. The slide board of the present invention also may be used as a testing device or assessment tool to measure range of motion and progress of athletes or patients. Whatever the use, a myriad of sliding movement patterns can be performed using the present invention.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

BRIEF DESCRIPTION OF THE DRAWINGS

FIG. 3 is a plan view of the slide board shown in FIGS. 1 and 2, wherein the repositional stops and grip handles have been removed from the base of the slide board;

FIG. 3*a* is a side view of the base shown in FIG. 3;

FIG. 5 is a plan view of a section of the base shown in FIG. 3;

FIG. 5*a* is side view of the section shown in FIG. 5;

FIG. 6*a* is a perspective view of the top of a repositional stop shown in FIGS. 1 and 2;

FIG. 6*b* is a perspective view of the bottom of a repositional stop shown in FIGS. 1, 2 and 6*a;*

DETAILED DESCRIPTION OF THE PREFERRED EMBODIMENTS

Figure 1:
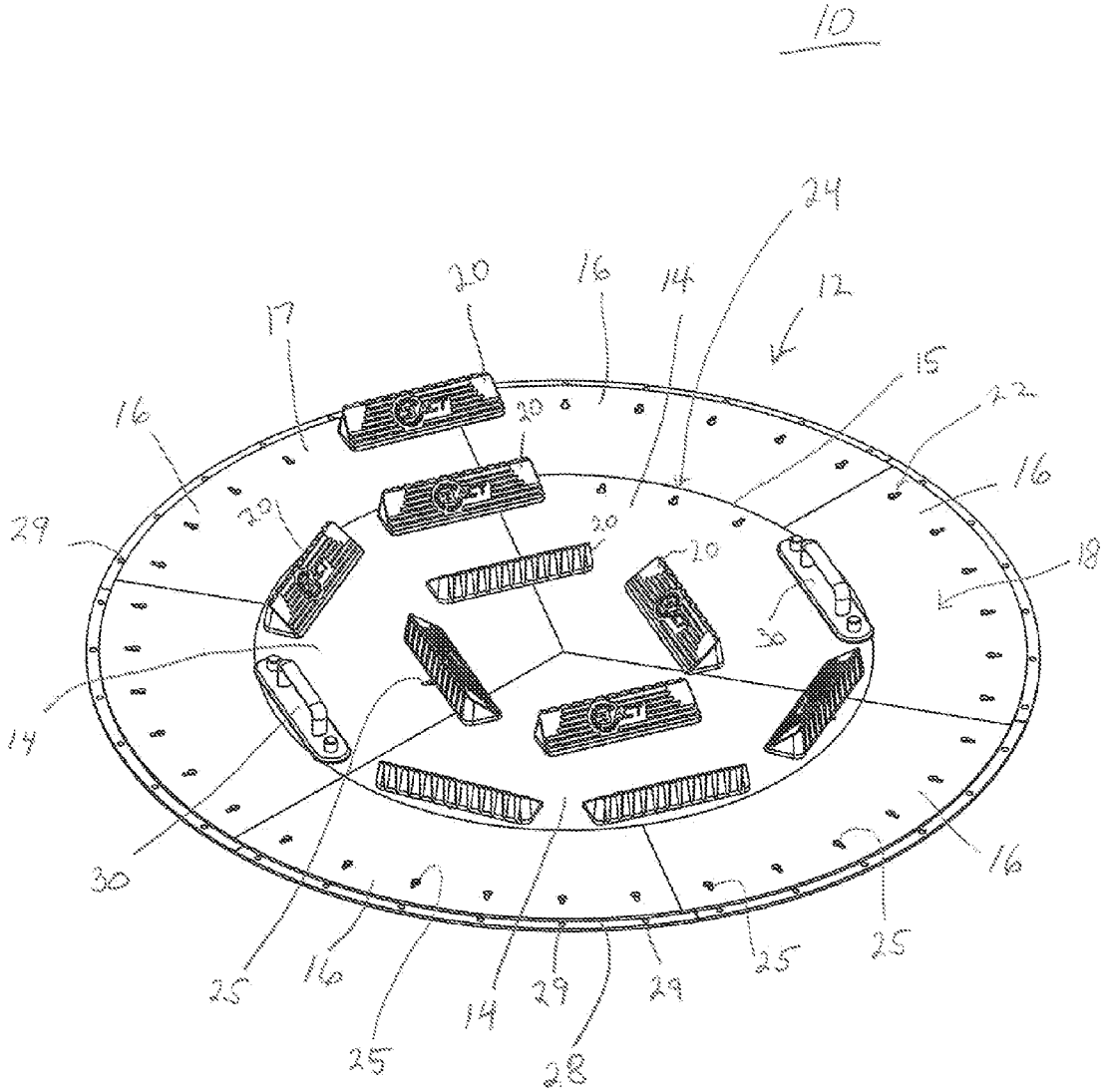
FIG. 1 is a perspective view of a circular shaped slide board configured in accordance with the present invention.

Referring now to the drawings, FIG. 1 illustrates a circular-shaped slide board 10 configured in accordance with the present invention. The slide board 10 includes a base 12 which is assembled from several smaller sectional components. The interconnected sectional components include three pie-shaped sections 14 which are interconnected to form a circle 15. The base 12 is constructed of additional interlocking sections 16 which are connected together to form a circular band 17 having a width and surrounding the outer periphery of the pie-shaped sections 14.

The interlocking sections 14 and 16 that form the base 12 can be made from numerous materials, such as a plywood frame with a Masonite top surface to create a smooth and slippery surface 18. In other embodiments birch plywood having a smooth plastic top surface can be used to form the base 12. The base 12 is approximately 6 feet in diameter in a preferred embodiment and includes three tiers of removable stops 20. The size of the circular base 12 can be increased by adding additional sections to the periphery of the sections 16.

The repositional stops 20 can be mounted to the top surface 18 of the base 12 in a myriad of patterns to provide a vast number of different distance and direction of slidable exercise patterns. The repositional stops 20, for example, can be placed in predetermined positions forming at least two octagonal tiers and a third square tier. The two octagonal tiers and the third square tier are provided by three circular patterns of apertures 22, 24 and 26 (FIG. 2), respectively. The repositional stops 20 also can be different colors so instructions on how to perform a specific exercise can be given verbally. For example, the verbal command to slide from red to green, green to blue, etc.

In the illustrated embodiment, the first circular pattern 22 of apertures 25 is located near the periphery of the base 12 and has the largest diameter of the three circular patterns. The second circular pattern 24 of apertures 25 has the second largest diameter and is located near the periphery defined by the pie-shaped sections 14. The third circular pattern 26 of apertures 25 is located closest to the center of the base 12 and has the smallest diameter of the three circular patterns 22, 24, 26 of apertures 25. Due to the smaller diameter of the third circular pattern 26 of apertures, the third circular pattern 26 preferably is designed to mount the repositional stops 20 in a square pattern, as shown in FIG. 1. Handle grips 30 also can be mounted to the base 12 in any desired location having apertures 25.

Figure 2:
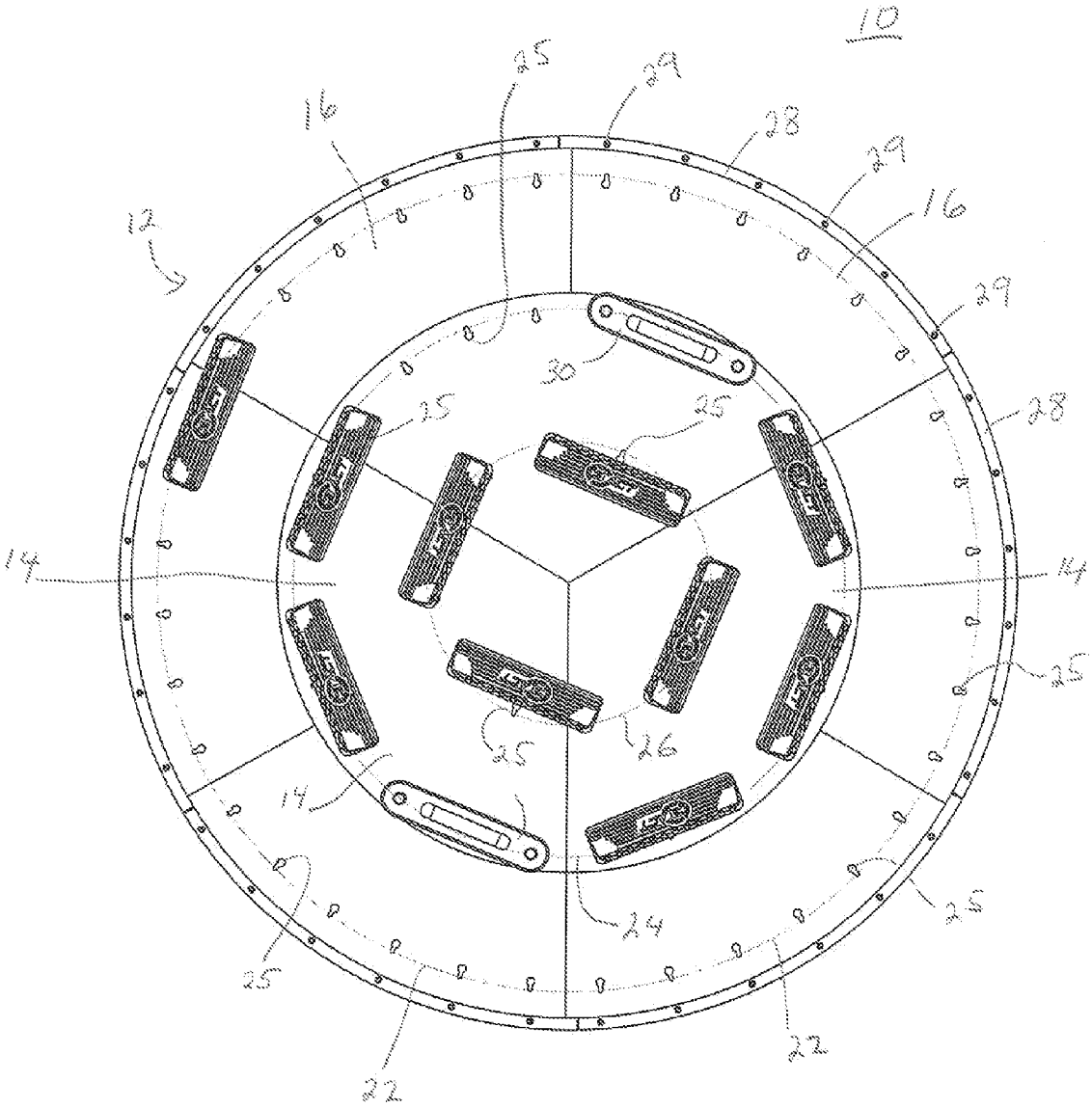
FIG. 2 is a plan view of the slide board shown in FIG. 1.

FIG. 2 is a plan view of the circular slide board 10 shown in FIG. 1. As illustrated in FIG. 1, the slide board 10 includes a base 12 having a circular configuration. A clearer view can be seen of the pie-shaped sections 14 and the outer sections 16 which form an outer circular band 17 having a defined width. The outer periphery of each of the sections 16 include a ridge 28 which is configured to slidably insert within a slot in additional sections (not shown) should a user decide to further expand the overall surface area and size of the base 12. Indentations 29 in the surface of the ridges 28 function to receive raised portions or tabs 35 (FIG. 4*a*) in additional sections desired to be added onto the currently existing sections 16 of the base 12.

Also clearly illustrated in FIG. 2 are imaginary lines 22, 24, and 26 which define the first, second and third circular patterns 22, 24, and 26 of apertures 25. A plurality of apertures 25 can be seen defining each of the circular patterns 22, 24, and 26. The tops of the repositional stops 25 also can be clearly seen. Finally, the tops of the grip handles 30 also can be clearly seen.

FIG. 3 is a plan view of the base 12 shown in FIGS. 1 and 2, wherein the repositional stops 20 and the grip handles 30 have been removed. FIG. 3 provides a clear view of the first plurality of apertures 25 arranged in a circular pattern 22, the second plurality of apertures 25 arranged in a circular pattern 24, and the third plurality of apertures 25 arranged in a circular pattern 26. In contrast to FIG. 2, the imaginary lines illustrating the first, second, and third circular patterns 22, 24, and 26 of apertures 25 are not shown. Furthermore, the apertures 25, it should be noted, are key-shaped, wherein the smaller width portion 31 is directed outward, and the larger diameter portion 33 of the key-shaped aperture 25 is directed inward. ???

FIG. 3*a* illustrates a side view of the base 12 shown in FIG. 3. The ridge 28 shown in FIG. 3 can clearly be seen in FIG. 3*a*.

Figure 4:
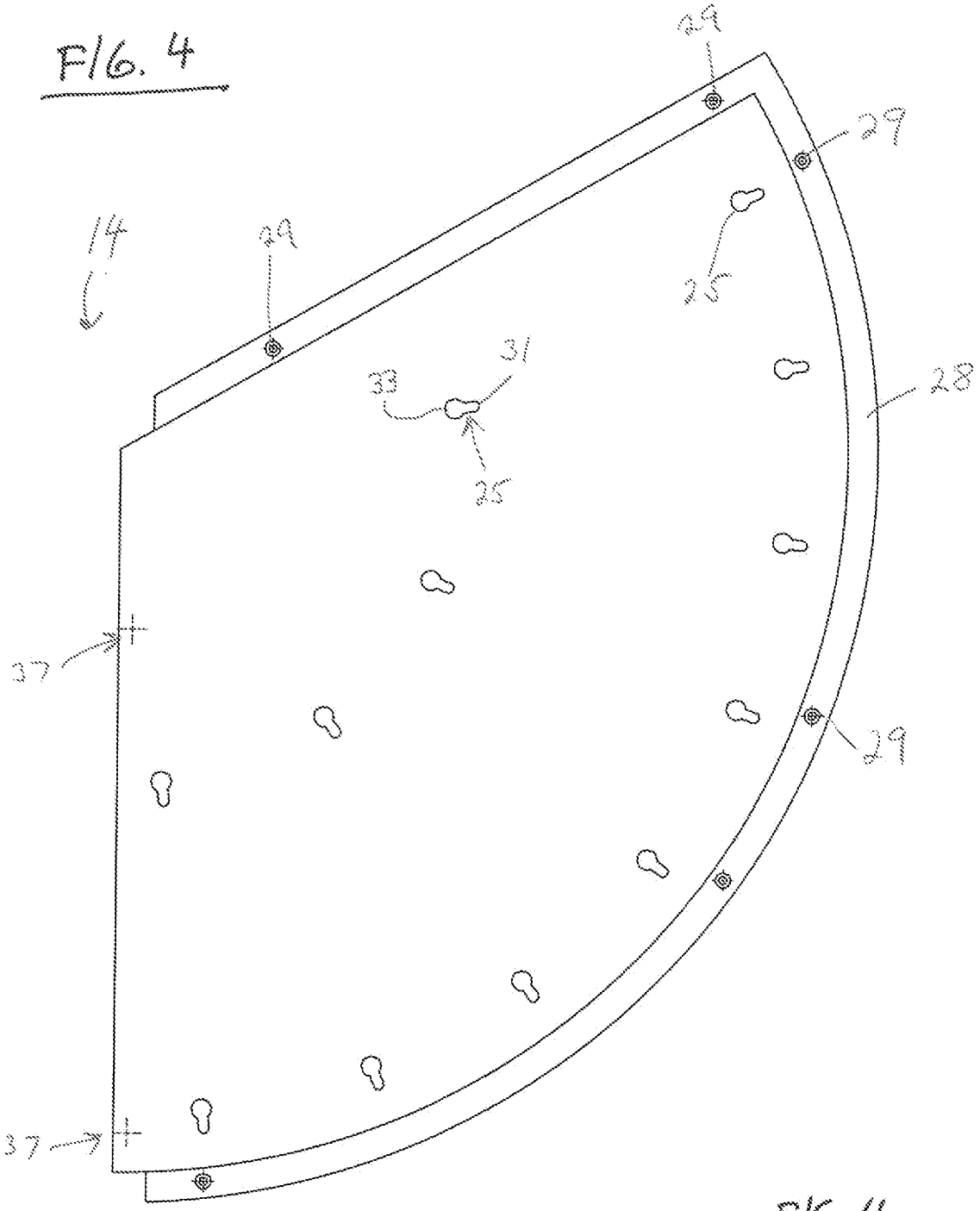
FIG. 4 is a plan view of a section of the base shown in FIG. 3.

FIG. 4 is an enlarged view of a pie-shaped section 14 shown in FIG. 3. FIG. 3 provides a clearer view of the key-shaped configuration of the apertures 25. The smaller diameter portions 31 of the key-shaped apertures are directed outward toward the periphery of the base 12, and the larger width or diameter portions 33 of the key-shaped apertures 25 are directed inward away from the periphery of the base 12. Additionally, the ridge 28 and the notches or indentations 29 can be clearly seen. The imaginary crosshairs 37 shown in FIG. 4 indicate where the downward facing tabs or raised portions 35 on the section 14 are located. These tabs 35 are configured and sized to fit within similarly sized notches 29 of the sections 14 when the sections 14 are assembled together.

Figure 4A:
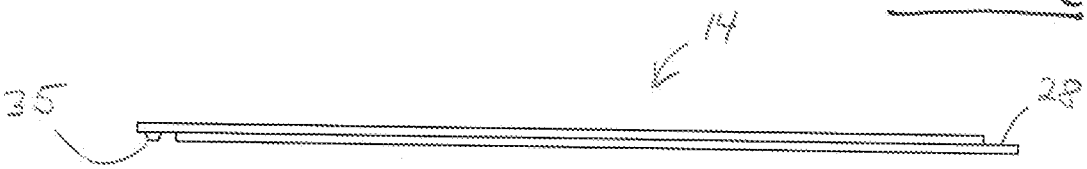
FIG. 4*a* is a side view of the section shown in FIG. 4.

FIG. 4*a* is a side view of the section 14 shown in FIG. 4. FIG. 4*a* provides a clear view of the ridge 28 and a tab 35 on the section 14.

FIG. 5 is an enlarged view of a section 16 shown in FIGS. 1, 2, and 3. Similar to section 14 shown in FIGS. 4 and 4*a*, section 16 includes a ridge 28 having notches 29. Also similar to FIG. 4, FIG. 5 illustrates crosshairs 37 indicating where tabs 35 are located on the underside of section 16. The apertures 25, having a key-shaped configuration with a larger width portion 33 and smaller width portion 31, also are shown in FIG. 5. Ridge 28 on the outer periphery of section 16, and notches 29 located within the ridge 28, can also be clearly seen in FIG. 5.

FIG. 5*a* is a side view of the section 16 shown in FIG. 5. Ridge 28 and the downward facing tabs 35 on the underside of section 16 are illustrated in FIG. 5*a*.

FIG. 6*a* is a perspective view of the top of a repositional stop 20 shown in FIGS. 1 and 2. The top surface 42 of the repositional stop 20 is inclined and includes non-slip ridges 44. In a preferred embodiment the angle of incline of the top surface 42 is about 40 degrees. A sidewall 46 of the repositional stop 20 illustrating the incline of the top surface 42 also is illustrated.

FIG. 6*b* is a perspective view of the bottom of the repositional stop 20 shown in FIG. 6*a*. A back wall 48 and the sidewall 46 are illustrated. Of particular importance, mounting posts 45 having a flat, larger diameter head, are further illustrated. The head of the mounting post 45 is sized and configured to fit into the larger width portion 33 of a key-shaped aperture 25 and slide to the smaller width portion 31, thereby locking the mounting post 45 within an aperture 25.

Figure 7A:
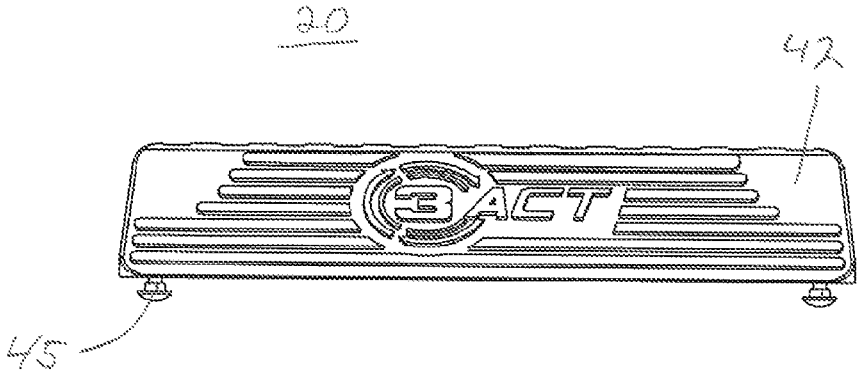
FIG. 7*a* is a front view of a repositional stop shown in FIGS. 1, 2, 6*a* and 6*b;*
Figure 7B:
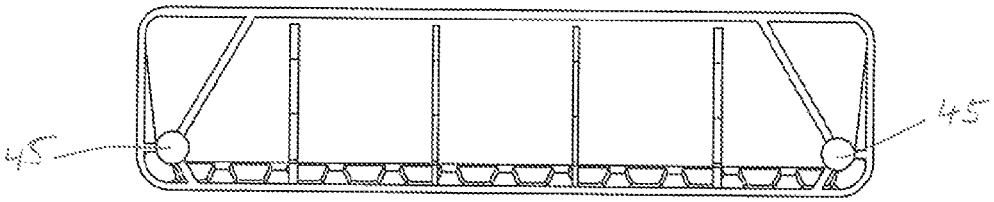
FIG. 7*b* is a bottom view of a repositional stop shown in FIGS. 1, 2, 6*a*, 6*b*, and 7*a;*
Figure 7C:
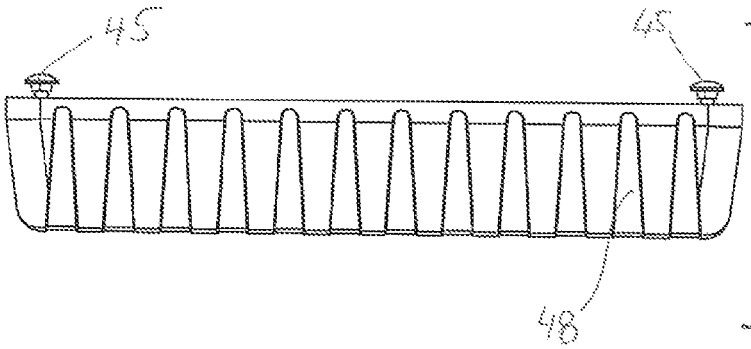
FIG. 7*c* is a back view of a repositional stop shown in FIGS. 1, 2, 6*a*, 6*b*, 7*a*, and 7*b;*

FIGS. 7*a*, 7*b*, and 7*c* are additional views of the repositional stop 20. FIG. 7*a* is a front view, FIG. 7*b* is a bottom view, and FIG. 7*c* is a back view. It can be seen in FIGS. 7*a* and 7*c* that the mounting posts 45 are bolts. Of course, the mounting posts 45 can be other configurations in other embodiments, such as nails with flat heads. The mounting post 45 can be constructed or metal or plastic. The repositional stops 20 are preferably constructed of plastic or rubber.

Figure 8:
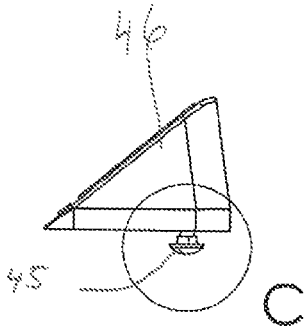
FIG. 8 is a side view of a repositional stop shown in FIGS. 1, 2, 6*a*, 6*b*, 7*a*, 7*b*, and 7*c;*

FIG. 8 is a side view of the repositional stop 20 shown in FIGS. 7*a*-7*c*. FIG. 8 includes a circular area designated as "C".

Figure 8A:
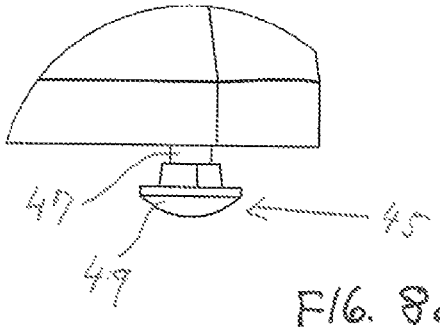
FIG. 8*a* is an enlarged view of the portion of FIG. 8 enclosed in the circled area designated as "C"

FIG. 8*a* is an enlarged view of the circular area designated as "C" in FIG. 8. The mounting post 45 is shown to be a bolt having a shaft 47 and head 49.

Figures 9A, 9B:
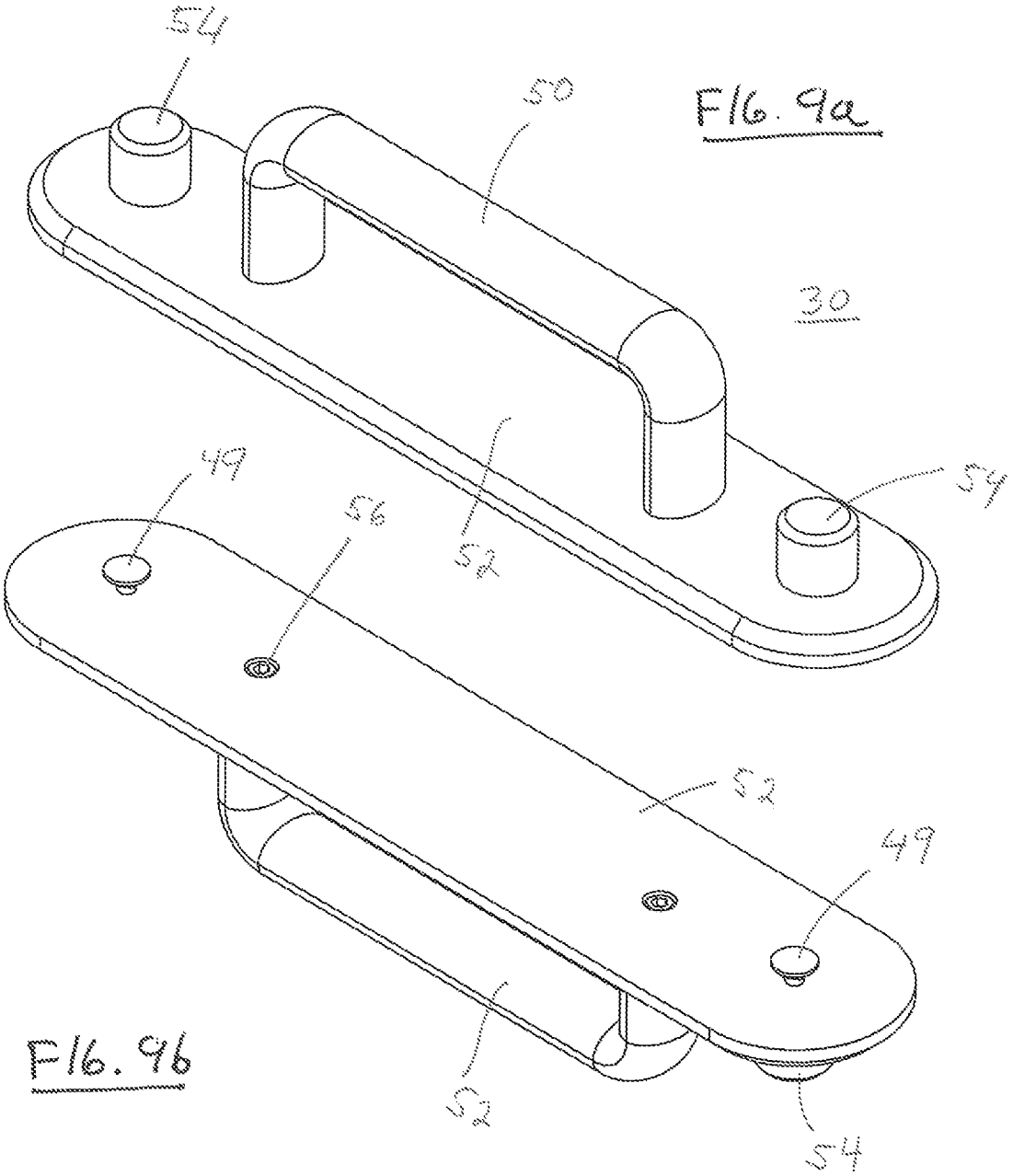
FIG. 9*a* is a perspective view of the top of the handle grip shown FIGS. 1 and 2.
FIG. 9*b* is a perspective view of the bottom of the handle grip shown FIGS. 1, 2, and 9*a;*

FIG. 9*a* is a perspective view of the top of the grip handle 30. The grip handle 30 includes an arm 50 mounted to the top of the base plate 52. Caps 54 also are attached to the top of the base plate 52. The grip handles 30 are preferably constructed of metal, plastic or wood, or a combination of any of the three.

FIG. 9*b* is a perspective view of the bottom of the grip handle 30. The grip handle 30 is mounted to the base plate 52 using bolts 56, such as hex key screws or bolts, which recede below the bottom surface of the base plate 52. Heads 49 of mounting posts 45 are shown on the bottom surface of the base plate 52.

Figure 10A:
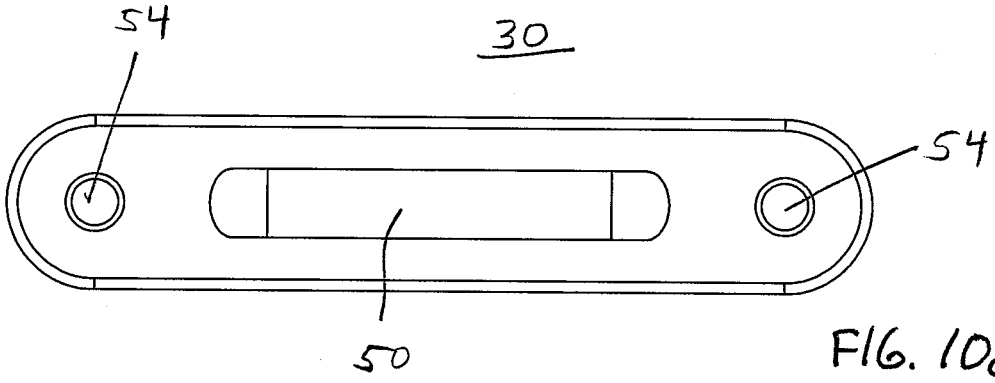
FIG. 10*a* is a plan view of the handle grip shown in FIGS. 1, 2, 9*a*, and 9*b;*
Figure 10B:
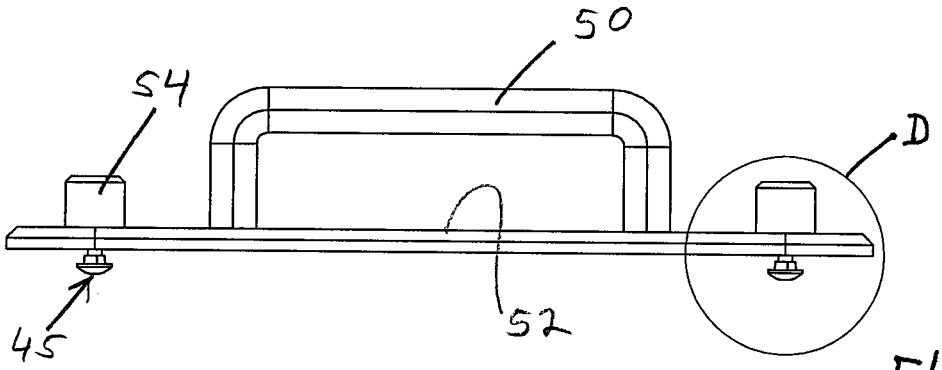
FIG. 10*b* is a side view of the handle grip shown in FIGS. 1, 2, 9*a*, 9*b* and 10*a;*
Figure 10C:
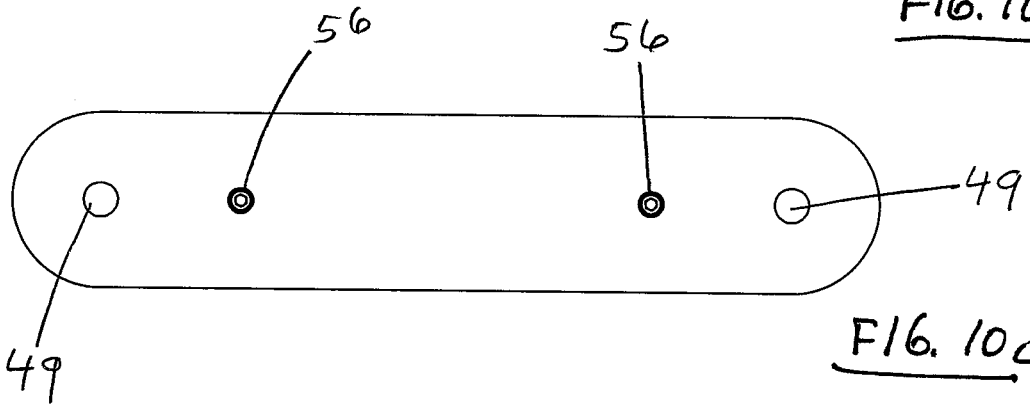
FIG. 10*c* a bottom view of the handle grip shown in FIGS. 1, 2, 9*a*, 9*b*, 10*a*, and 10*b;*
Figure 10D:
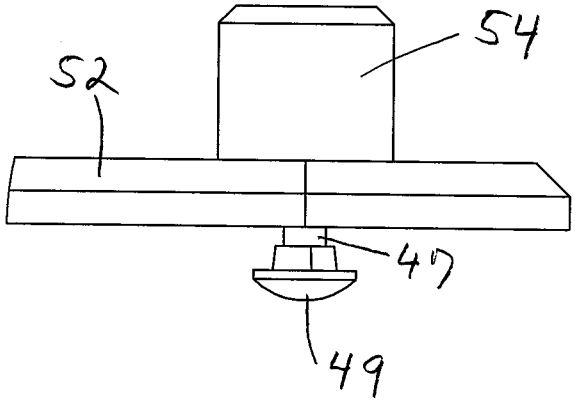
FIG. 10*d* is an enlarged view of the portion of FIG. 10*b* enclosed in the circled area designated as "D"

FIGS. 10*a*-10*d* provide additional views of the grip handle 30 shown in FIGS. 1, 2, and 9*a* and 9*b*. FIG. 10*a* is a plan view of the grip handle 30, FIG. 10*b* is a side view of the grip handle 30, and FIG. 10*c* is a bottom view of the grip handle 30. FIG. 10*d* is an enlarged view of the circular area in FIG. 10*b* designated as "D". In FIG. 10*d* the mounting post 45 is shown to be a bolt having a shaft 47 and head 49. The mounting post 45 is secured to the base plate 12 by passing through the base plate 52 and being secured within the cap 54 on the top surface of the base plate 52.

Figure 11A:
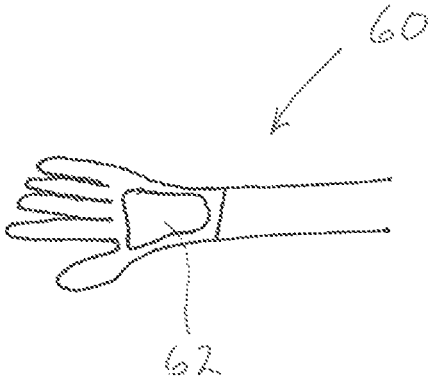
FIG. 11*a* is a plan view of a glove configured in accordance with the present invention.

FIG. 11*a* is a glove 60 configured in accordance with the present invention. The glove 60 is constructed of a friction-reducing material to facilitate sliding exercises on the base 12. The glove 60 also can include a friction-reducing pad 62. The glove 60 and/or pad 62 is preferably constructed of a durable, friction-reducing synthetic material that conforms to many different sizes of hands.

Figure 11B:
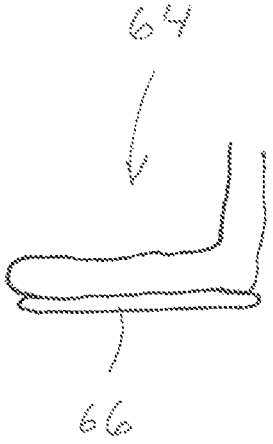
FIG. 11*b* is a side view of a slipper configured in accordance with the present invention.

FIG. 11*b* is a slipper 64 configured in accordance with the present invention. The slipper is constructed of a friction-reducing material to facilitate sliding exercises on the base 12. The slipper 64 also can include a friction-reducing pad 66. The slipper 64 and/or pad 66 is preferably constructed of a durable, friction-reducing synthetic material that conforms to many different sizes of feet.

Figure 11C:
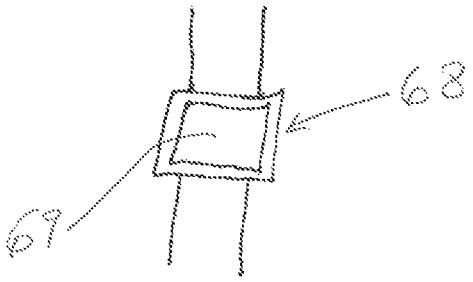
FIG. 11*c* is a knee pad configured in accordance with the present invention.

FIG. 11*c* is a knee brace 68 configured in accordance with the present invention. The knee brace 68 is constructed of a friction-reducing material to facilitate sliding exercises on the base 12. The knee brace 68 also can include a friction-reducing pad 69. The knee brace 68 and/or pad 69 is preferably constructed of a durable, friction-reducing synthetic material that conforms to many different sizes of knees.

The circular slide board 10 of the present invention is designed to allow the repositional stops 20 to be in three tiers, placed in predetermined positions, around the base 12, thus enabling a wide variety of different motions with various stopping and starting points. The repositional stops 20 can be changed to achieve different positions, angles, and guided activity patterns to promote the most functional triplanar motion. The present invention enables slide movements that are that not only the traditional side to side motion, but in numerous additional motion patterns. The slide board 10 also enables users to exercise their upper body by sliding on their hands and knees or toes and hands in a push up position, with hands going out in various planes of motion. Furthermore, knees can be moved in similar movement patterns. All sliding exercises can be achieved using a sliding accessory to allow for optimal sliding motion. The accessory can be used for the hands, feet and knees accordingly.

The base 12 is created with a sturdy material that is cut in a circular shape with pre-established locations for the repositional stops 20 to push off and stop from. The sliding board 10 of the present invention can be used in multiple locations, such as: in the home for personal exercise programs; in health clubs and fitness facilities for personal training and group classes; in physical therapy settings for all types of rehabilitation; in athletic training rooms for preventing and treating injuries; in schools for physical education; and in professional athletic environments for performance enhancement.

To exercise, for example, using the sliding board 10 of the present invention, a non-stick slipper is places over a user's shoes to enable the user to slide across the top surface of the base 12. This is achieved by pushing off the repositional stops 20 to get from one side to the other. The user can change the sliding distance as well as the direction, by moving the repositional stops 20 into different patterns. The different stopping positions also allow the user to keep one part of the body stationary while sliding the other, in order to achieve the desired effect. The unique octagonal design of the repositional stops 20 is what allows the triplanar motions to be achieved, therefore, allowing exercise for the entire body in numerous ways.

What is claimed is:

1. An adjustable exercise apparatus, comprising:

a base having a top surface and a bottom surface, wherein the top surface is smooth and planar;

said top surface including a first plurality of apertures arranged in a first circular pattern wherein the first circular pattern has a first diameter;

said top surface including a second plurality of apertures arranged in a second circular pattern wherein the second circular pattern has a second diameter and wherein the second circular pattern surrounds the first circular pattern; and a plurality of repositional stops including mounting posts configured to be selectively received within selected apertures of the first or second plurality of apertures for selectively securing the repositional stops to the selected apertures of the first or second plurality of apertures, and wherein the positions of the plurality of repositional stops in both the first plurality of apertures and the second plurality of apertures include positions in which at least two repositional stops are not parallel.

2. The adjustable exercise apparatus of claim 1, wherein the base has a circular configuration at an outer periphery of the base.

3. The adjustable exercise apparatus of claim 2, wherein the base includes a plurality of unitary pie-shaped, interconnecting pieces that have an outer periphery which collectively are configured to form a circle when connected together.

4. The adjustable exercise apparatus of claim 1, said the top surface including a third plurality of apertures arranged in a third circular pattern wherein the third circular pattern has a third diameter and wherein the third circular pattern surrounds the second circular pattern, and wherein the positions of the plurality of repositional stops in the third plurality of apertures include positions in an octagon arrangement.

5. The adjustable exercise apparatus of claim 1, further comprising: footpads to be worn by a user to reduce friction between the top surface of the base and movement of a user's feet, wherein a bottom surface of each footpad is constructed of a friction-reducing material, and wherein the positions of the plurality of repositional stops in the second plurality of apertures include positions in an octagon arrangement.

6. The adjustable exercise apparatus of claim 1, further comprising: hand pads to be worn by a user to reduce friction between the top surface of the base and movement of a user's hands, wherein a bottom surface of each hand pad is constructed of a friction-reducing material, and wherein the positions of the plurality of repositional stops in the second plurality of apertures include positions in an octagon arrangement.

7. The adjustable exercise apparatus of claim 1, further comprising: slippers to be worn by a user to reduce friction between the top surface of the base and movement of a user's feet, wherein the slippers are constructed of a friction-reducing material, and wherein the positions of the plurality of repositional stops in the second plurality of apertures include positions in an octagon arrangement.

8. The adjustable exercise apparatus of claim 1, further comprising: gloves to be worn by a user to reduce friction between the top surface of the base and movement of a user's hands, wherein the gloves are constructed of a friction-reducing material, and wherein the positions of the plurality of repositional stops in the second plurality of apertures include positions in an octagon arrangement.

9. The adjustable exercise apparatus of claim 1, further comprising: at least one handle configured to be attached to select ones of the first and second plurality of apertures, each said handle including mounting posts for securing the handle within select ones of the first and second plurality of apertures.

10. The adjustable exercise apparatus of claim 1, wherein each aperture of the first and second plurality of apertures include a keyhole configuration having a larger diameter portion and a smaller diameter portion, wherein the smaller diameter portion of the keyhole configurations are located closer to an outer periphery of the base than the larger diameter portion of the keyhole configurations.

11. The adjustable exercise apparatus of claim 1, wherein the first and second circular patterns are concentric, and wherein the positions of the plurality of repositional stops in the second plurality of apertures include positions in an octagon arrangement.

12. The adjustable exercise apparatus of claim 1, wherein the top surface of the base is constructed of composite board and wherein first and second circular patterns are concentric.

13. The adjustable exercise apparatus of claim 1, wherein each of the repositional stops have a rectangular configuration, and wherein the positions of the plurality of repositional stops in the second plurality of apertures include positions in an octagon arrangement.

14. The adjustable exercise apparatus of claim 1, wherein each of the repositional stops have a rectangular configuration and an inclined top surface with non-slip ridges.

15. The adjustable exercise apparatus of claim 1, wherein the base includes a plurality of interlocking pie-shape pieces that have an outer periphery which collectively are configured to form a circle when interconnected.

16. The adjustable exercise apparatus of claim 15, wherein the base is further includes a plurality of interlocking sections of an annular circular band.

17. The adjustable exercise apparatus of claim 11, wherein each of the posts are metal bolts.

18. The adjustable exercise apparatus of claim 1, wherein each repositional stop includes two posts, and wherein the positions of the plurality of repositional stops in the second plurality of apertures include positions in an octagon arrangement.

19. The adjustable exercise apparatus of claim 1, further comprising: a hand pad constructed of friction-reducing material, and wherein the positions of the plurality of repositional stops in the second plurality of apertures include positions in an octagon arrangement.

20. The adjustable exercise apparatus of claim 1, further comprising: a footpad constructed of friction-reducing material, and wherein the positions of the plurality of repositional stops in the second plurality of apertures include positions in an octagon arrangement.

* * * * *